United States Patent [19]

Simkens

[11] Patent Number: 4,641,501

[45] Date of Patent: Feb. 10, 1987

[54] DEVICE FOR MAKING ICE CUBES

[76] Inventor: Marcellus C. P. L. Simkens, Hoogweg 24, B - 8050 Wingene, Belgium

[21] Appl. No.: 826,901

[22] Filed: Feb. 6, 1986

[30] Foreign Application Priority Data

Feb. 14, 1985 [BE] Belgium ..... 901732

[51] Int. Cl.[4] ..... F25D 17/02

[52] U.S. Cl. ..... 62/188; 62/348

[58] Field of Search ..... 62/188, 74, 347, 348

[56] References Cited

U.S. PATENT DOCUMENTS 3,009,336 11/1961 Baystow et al. ..... 62/347 X 3,423,952 1/1969 Pugh ..... 62/347 X

*Primary Examiner*—William E. Wayner

*Attorney, Agent, or Firm*—Stevens, Davis, Miller & Mosher

[57] ABSTRACT

Water from a water tank is sprayed through spraying openings against a plate and ends, projecting underneath the plate, of metal rods. These rods are clamped between line portions through which cooling liquid flows in opposite directions. The excess water returns to water tank over a collecting tray provided with an outlet. A movable water-guiding member is mounted underneath this outlet and is connected to a float in the water tank. When nearly enough ice has been formed, the water level in the tank has so fallen that the float brings the movable member in a position whereby it diverts water to a discharge pipe. The minimum level in tank, with which the cooling cycle is stopped and fresh water is supplied to tank over the first mentioned plate, is then quickly reached.

16 Claims, 9 Drawing Figures

DEVICE FOR MAKING ICE CUBES

BACKGROUND OF THE INVENTION

The invention relates to a device for making ice cubes, which device comprises:

a cooling device with at least one cooling element, a water circuit which comprises:

a water tank, means for feeding water from the water tank to the cooling element, and means for returning the excess water, which has not been converted to ice, to the water tank, means for supplying before the ice formation water to said water tank, water discharge means, means for thawing somewhat after the ice formation, that ice formed on the cooling element, so that said ice is released from said cooling element, a control device which so controls the means for supplying water to the water tank, the means for feeding water to the cooling element and the means for thawing somewhat the ice after its formation, that, before forming the ice, some water is added to the water tank, after adding said water, the supply is stopped, and as soon as enough ice has been formed on the cooling element, the means for feeding water from the water tank to the cooling element, stop the water feed, and the means for thawing somewhat the ice, are started, and means for diverting during the ice formation, a portion of that water circulating in the water circuit and leading same to the water discharge means.

A device of this kind is disclosed in U.S. Pat. No. 3,009,336.

The water circuit of said device comprises a number of cooling compartments mounted on the underside of the cooling element. The bottom of said compartments is formed by a pivoting bottom plate. Water pumped from the water tank is sprayed in the compartments through feeding openings in said bottom plate and the excess water, which is not converted into ice, returns through discharge openings in said bottom plate to the water tank. A nozzle is mounted on the feeding tube connecting the pump to the feeding openings and sprays part of the pumped water in a box mounted above the water tank. Said box is divided in two compartments. The first compartment nearest to the nozzle presents a discharge opening through which water returns to the water tank, the second compartment connects to the outlet means. The nozzle normally sprays water in the first compartment but when the cooling compartments are nearly completely filled with ice, the spraying of water into said cooling compartments gets more difficult and the pressure in the feeding tube rises. The nozzle sprays therefore farther and, when the end of the ice-forming is nearly reached, sprays in the second box compartment. The sprayed water is so evacuated through the discharge means, which has for result a quick lowering of the water level in the water tank. When said level reaches a determined minimum the control device stops the pump, causes the opening of the compartments by pivoting the bottom plate and starts the thawing so that the ice is released from the compartments.

As just before the end of the ice-forming, part of the water is withdrawn from the water circuit, and when the next cycle starts, more water is fed than necessary to the ice-forming, a water freshening is obtained and the concentration in salts and dirt in the water remains low. Good quality ice cubes may be made from normal, that is not demineralized drinking water.

The construction of said known device is however very complicated, amongst others because the water circuit has to comprise compartments which have to be closed during the ice-forming but which must be opened in order to release the formed ice. A swingable bottom plate is thus required.

The device has also to be provided with a well determined type of cooling element forming compartments with said bottom plate. The means for withdrawing part of the water from the water circuit at the end of the ice-forming cycle described in U.S. Pat. No. 3,009,336 cannot be used in devices having another type of cooling element.

The invention has now for object to obviate these drawbacks and to provide a device for making ice cubes of the above-defined type, wherewith not only very good quality ice cubes may be made from normal, that is not demineralized drinking water, but which is very simple in structure and can be used irrespective of what type the cooling element is.

THE INVENTION

For this purpose, the means for diverting a portion of the water flowing round in the water circuit comprise a movable water-guiding member which is mounted in or on the water circuit, which member is movable between a position wherein at least a portion of the water flowing in said circuit is diverted to the water discharge means and a position wherein diverting does not occur, and which member is controlled by the control device so as to move from one position to the other in function of the water level in the water tank.

In a particular embodiment of the invention, the means for returning the excess water comprise a collecting tray which is arranged underneath the cooling element and collects the water which is not used for forming ice, said tray being provided with an outlet to discharge part at least of the collected water, which outlet opens on the water tank, while the means for diverting at least a portion of the water are mounted underneath said outlet so that in one position at least of the movable member a portion of the water returning from the cooling element is diverted.

In an advantageous embodiment of the invention, the control device comprises a float which is mounted inside the water tank, said float so controlling the means for feeding water to the cooling element that when the water in the water tank falls below a determined level, said means are cut out and the water feed to the cooling element stops, and the movable member is connected to said float and is brought by said float from one position to the other.

The movable member may be a trough which is swingably mounted about a substantially horizontally and in its cross-wise direction directed axis, above the water tank, and in one position, lies on the one hand whith its uppermost end opposite said tray outlet to collect part at least of the water flowing out of said tray outlet, and opens on the other hand with its lowest end on said water discharge means, which trough is so connected to the control device float that when said float falls below some determined limit, the trough is brought to the last-mentioned position.

The movable member may also be a deflector fixed on the float, the means for diverting at least a portion of the water comprising also a slanting trough mounted with its lowermost end opening on the water discharge means and with its uppermost end lying opposite the tray outlet so that the tray outlet opens on it, the deflector lying in one position between the tray outlet and the uppermost end of the trough, so as to deflect water from the tray outlet to the water tank and lying in another, lower position sufficiently away from the tray outlet to permit water streaming from the tray outlet in the trough and over the trough to the discharge means.

In a useful embodiment of the invention, the device comprises at least one immersion element which is so mounted as to be adjustable in the height inside the water tank, and defines the water amount for the highest level inside the water tank.

In a preferably-applied embodiment of the invention, the cooling element comprises a plate which lies at an angle to the vertical direction, a number of downwardly-directed fingers which extend through the plate, and a line for cooling liquid which engages said fingers on the plate top side, while the means for feeding water to the cooling element, comprise means for moistening the bottom side of said plate and the ends, projecting underneath said plate, of said fingers, and the means for returning the excess water to the water tank comprise a collecting tray which is arranged underneath said plate.

Usefully the cooling liquid line comprises at least one pair of line portions extending in parallel relationship with one another, and those finger ends lying above the plate are located between the line portions from a pair, in engagement with said line portions.

Preferably the cooling device comprises means for directing cooling liquid in the opposite flow direction through both line portions from a pair.

Due to the flow in opposite directions, there is obtained a uniform cooling of said fingers and consequently a uniform ice forming on the fingers.

Said fingers are preferably solid metal rods and the plate also is preferably made from metal.

Other features and advantages of the invention will stand out from the following description of a device for making ice cubes according to the invention; this description is only given as example and does not limit the invention; the reference numerals pertain to the accompanying drawings.

DRAWINGS

In the various figures, the same reference numerals pertain to the same elements.

DESCRIPTION OF PREFERRED EMBODIMENTS

Figure 1:
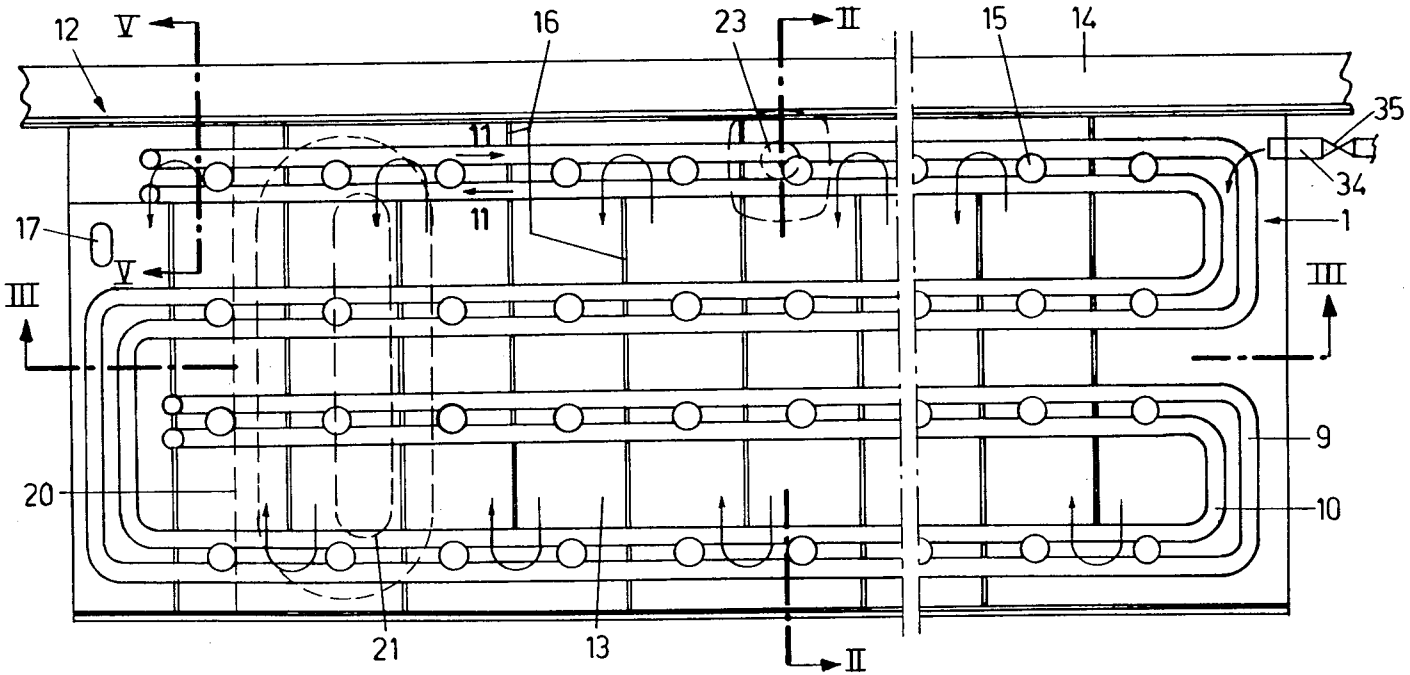
FIG. 1 is a top view of a device for making ice cubes according to the invention.
Figure 2:
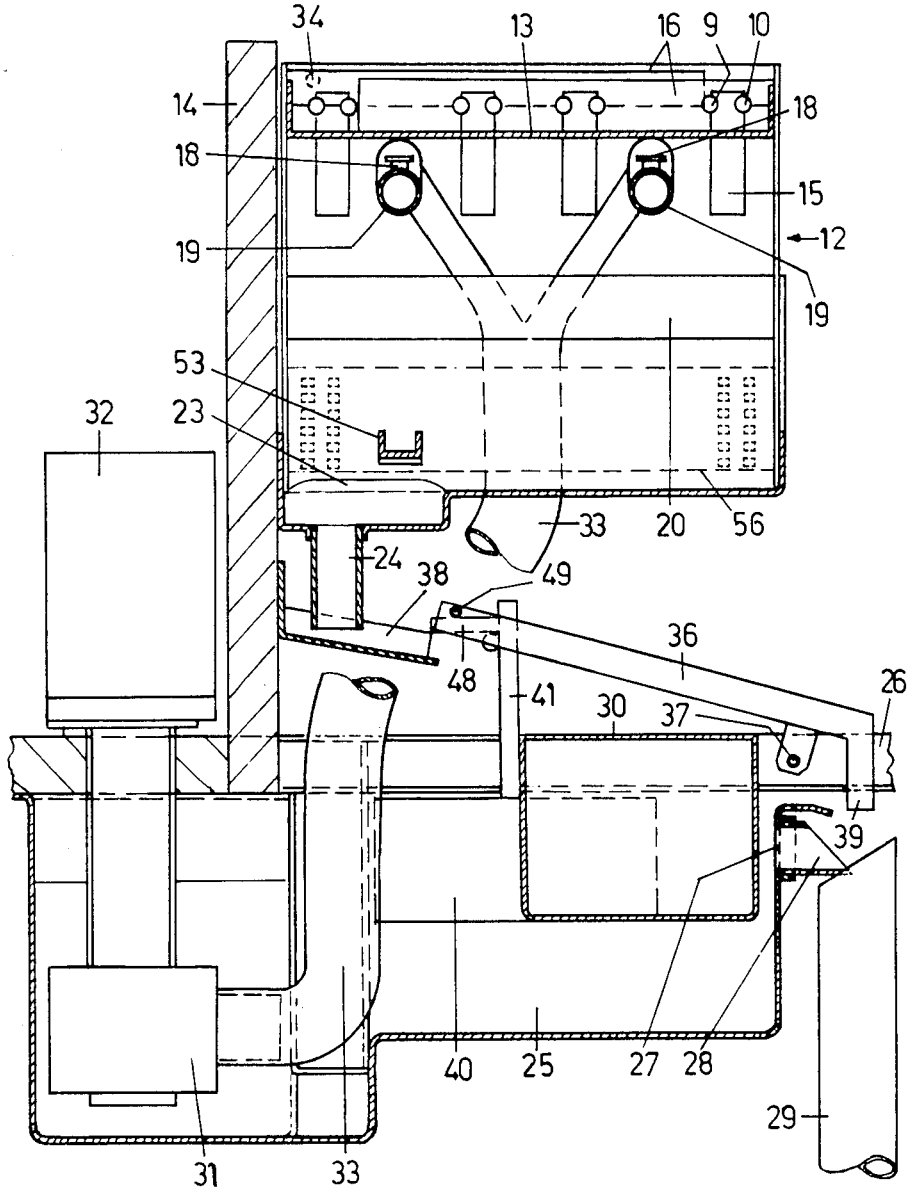
FIG. 2 shows a cross-section along line II—II in FIG. 1.
Figure 3:
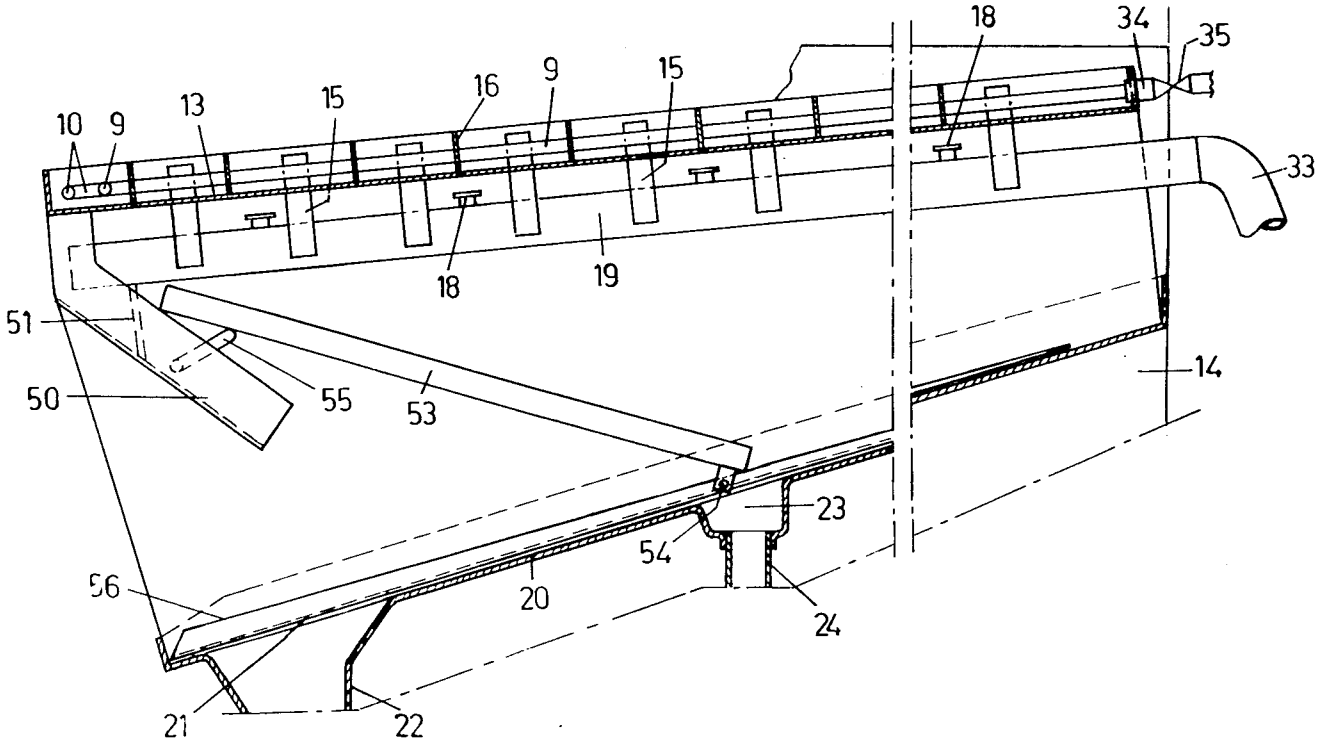
FIG. 3 shows the uppermost portion of a cross-section along line III—III in FIG. 1.
Figure 4:
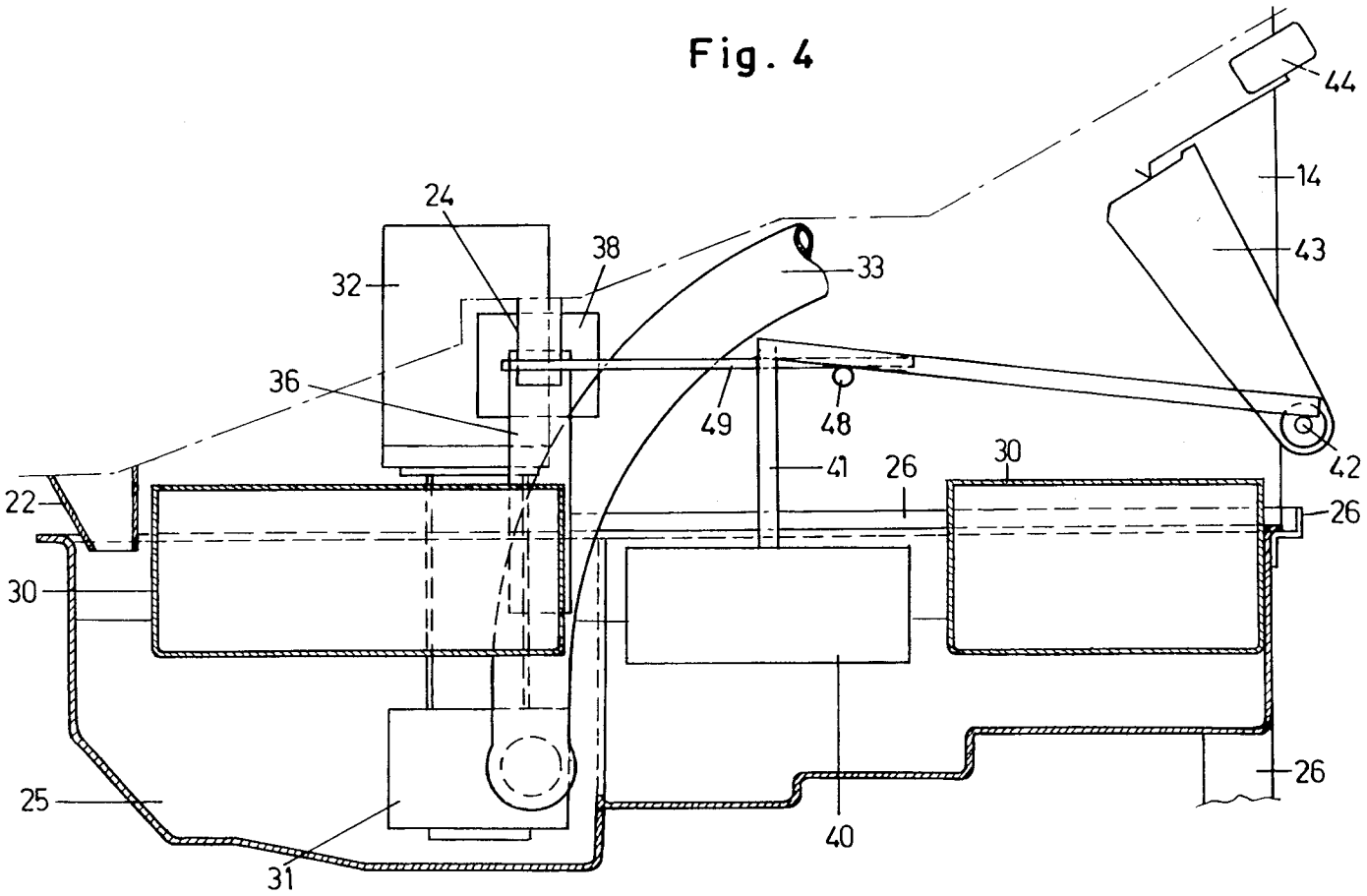
FIG. 4 shows the lowermost portion of the cross-section along line III—III in FIG. 1.
Figure 5:
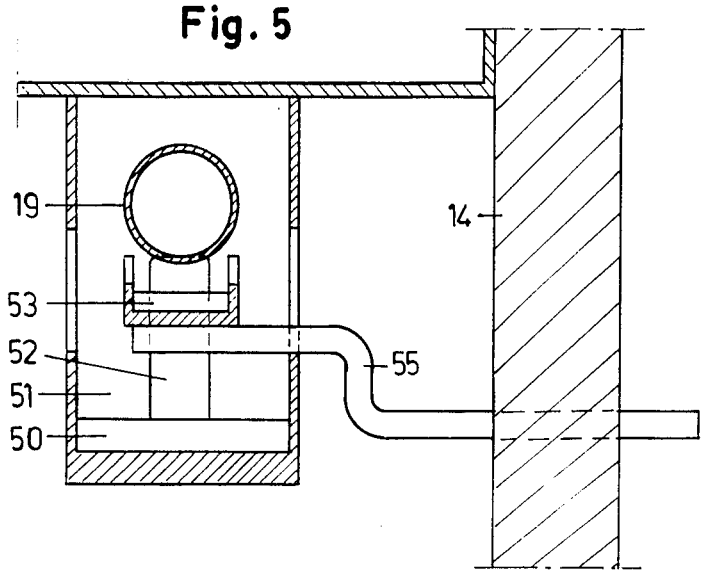
FIG. 5 shows a cross-section along line V—V in FIG. 1, but drawn on a markedly larger scale.
Figure 6:
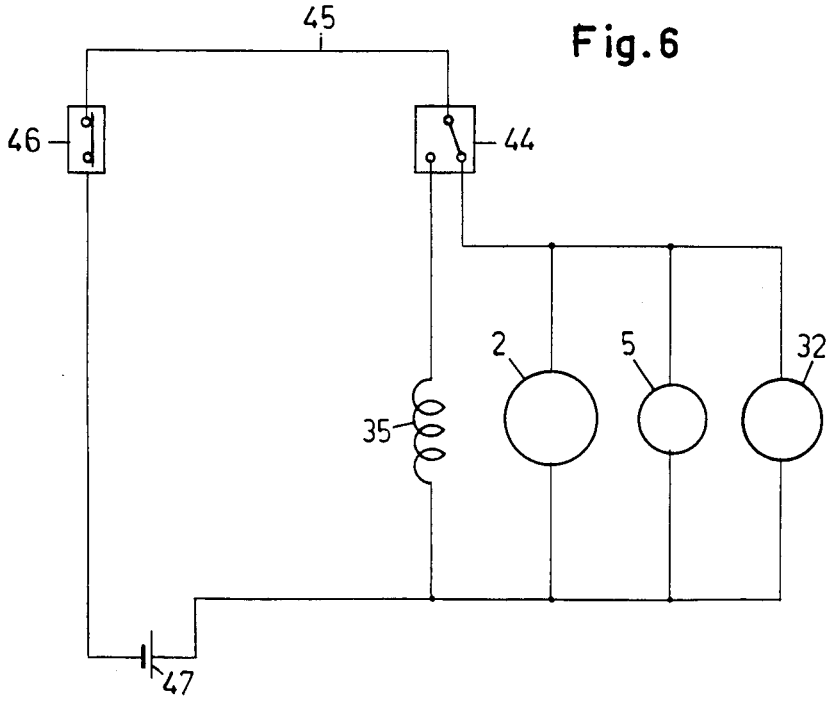
FIG. 6 shows an electric diagram of the device for making ice cubes as shown in the previous figures.
Figure 7:
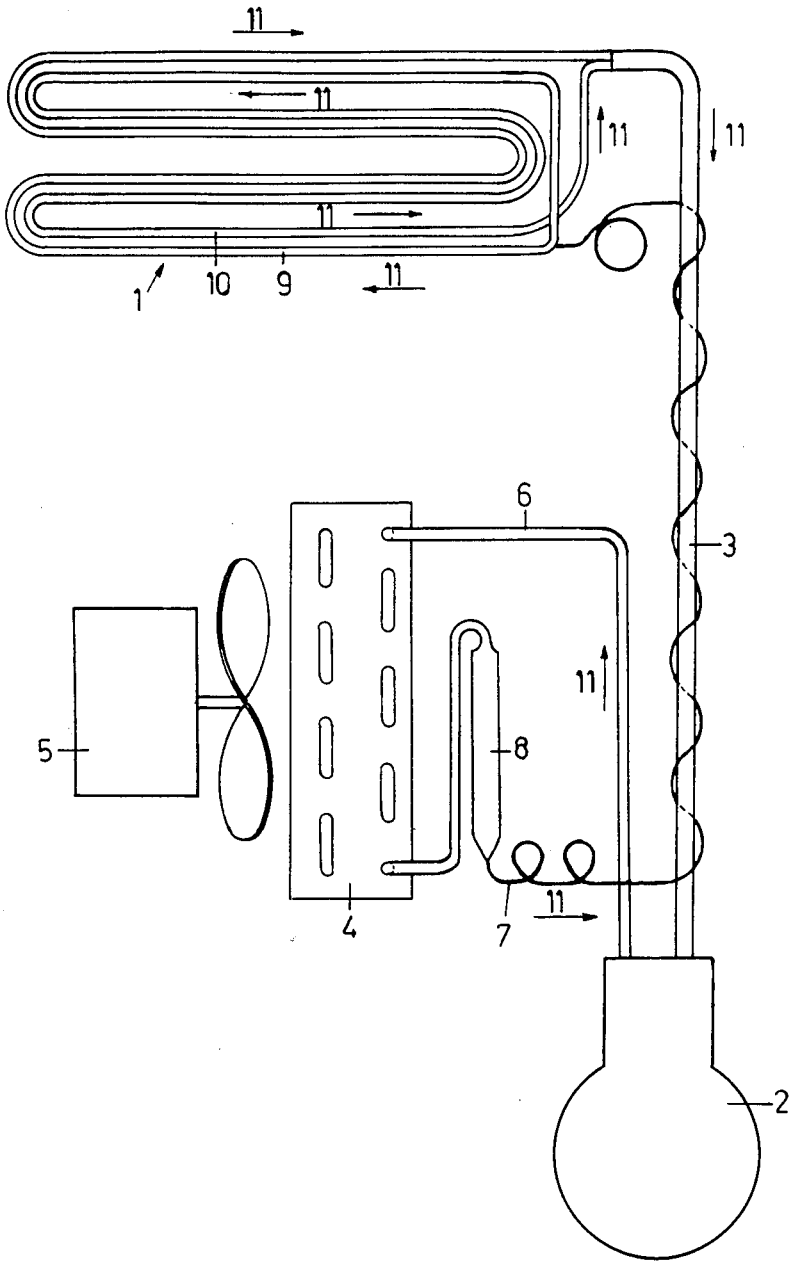
FIG. 7 is a diagrammatic showing of the cooling device from the device as shown in FIGS. 1 to 5.

The device for making ice cubes as shown in the FIGS. 1 to 7 comprises a cooling device which is shown diagrammatically in FIG. 7, with the exception of part of the cooling element.

Said cooling device comprises an evaporator 1, a compressor 2, a suction line 3 between the suction side of compressor 2 and the outlet of evaporator 1, a condenser 4, a fan 5 for cooling the condenser 4, a connection line 6 between the pressure side of compressor 2 and the inlet to condenser 4, and a capillary tube 7 which connects on the one hand to the inlet of evaporator 1, and connects on the other hand through a filter-dryer 8, to the outlet of condenser 4. The device is filled with a cooling fluid.

To the exception of the particular structure of the cooling element 12 with the evaporator 1, said cooling device is of a structure known per se, so that it will not be detailed hereafter but so far as necessary to make clear the invention.

When compressor 2 operates, due to condensing of the cooling liquid, heat is abandoned in condenser 4. The fan 5 then operates to cool said condenser 4. Due to expanding of the cooling liquid inside evaporator 1, said evaporator 1 absorbs heat.

A characteristic lies in the evaporator 1 being divided into two line portions 9 and 10 which extend in parallel relationship to one another. The ends of one line portion of said evaporator are crossed-over relative to the ends of the other evaporator line portion 10, whereby thus both line portions 9 and 10 of evaporator 1 so connect to suction line 3 and capillary tube 7 that the cooling fluid flows in opposite directions through the line portions extending in parallel relationship to one another. The fluid flow directions are shown by arrows 11 in FIGS. 1 and 7.

The evaporator 1 is part of the cooling element 12 of the device, which cooling element 12 comprises a rectangular plate 13 from stainless steel which is arranged with the cross-wise direction thereof horizontal and the lengthwise direction thereof slightly slanting. The lengthwise edges of plate 13 and the short side edge which lies lowest, are bent upwards. With a lengthwise edge thereof, the plate 13 is fastened to an upstanding wall 14 of the device frame.

A number of solid rods 15 from red copper go through said plate 13. Said rods 15 are arranged in four rows extending along the plate lengthwise direction. The rods 14 are clamped into openings of plate 13.

Those ends lying above plate 13 of rods 15 lie clamped between both line portions 9 and 10 of evaporator 1. Said line portions 9 and 10 are somewhat recessed inside grooves in the uppermost ends of rods 15, as it appears mostly from FIG. 2. In this way a good contact is obtained between line portions 9 and 10 and rods 15.

On the top side of plate 13, partitions 16 are standing, and next to the lowermost end, an opening 17 is provided in plate 13.

As inside line portions 9 and 10 on either side of rods 15, the cooling liquid flows in opposite directions, a more uniform temperature is obtained for the rods 15 and consequently also there is obtained a more uniform thickness for the ice cubes which are formed around said rods 15 on the lower side of plate 13.

To form said ice, the lower side of plate 13 is sprayed with water which is fed through two spray lines 19 provided with spraying openings 18, one opening 18 in the centre of each array of four rods 15. The water sprayed on plate 13 irrigates the ends projecting underneath said plate, of rods 15.

The excess water, that is the water which is not converted into ice around the rods 15, is collected again on an oblong collecting tray 20 with bent-up edges. Said tray 20 is fastened underneath cooling element 12, with a lengthwise edge to wall 14, and it lies slanting downwards in the same direction as plate 13, but somewhat more strongly.

At the lowermost end thereof, there is provided in said collecting tray 20, an oblong opening 21 whereto a discharge part 22 connects on the bottom side.

Substantially half-way along the length thereof, an additional round opening 23 is provided in said collecting tray 20, whereon, on the bottom side, a vertical pipe 24, open at the bottom, connects. A small trough 38 is fastened to be adjustable in the height, below the lowermost end of pipe 24, to wall 14 and slants away downwards from said wall 14.

As well the discharge part 22 as the pipe 24 open on a water tank 25 mounted underneath tray 20 which together with spray lines 19 and collecting tray 20, is part of a water circuit.

The water tank 25 hangs from an underframe 26 which bears said wall 14.

In the one side wall thereof, the water tank 25 is provided with an opening 27 whereon a small pipe 28 connects on the outer side. Said opening 27 and small pipe 28 form an overflow which defines the highest water level inside water tank 25.

The small pipe 28 opens in the open uppermost end of a vertical discharge pipe 29 fastened to underframe 26.

That water amount which corresponds to said highest level may be adjusted with an immersion element 30. Said immersion element 30 is so mounted as to be adjustable in the height inside water tank 25, for example by means of a pin which cooperates with a batten provided with holes and secured to the water tank.

Inside said water tank 25 a pump 31 is arranged. The pump 31 which lies below the water level, is driven by an electric motor 32 which is mounted next to wall 14 and collecting tray 20, above the water tank 25, on underframe 6.

Said pump 31 sucks water directly from water tank 25 and pumps it through the hose 33, the end of which branches out, to said two spray lines 19.

Water may be added to the herebefore described water circuit through a water supply line 34, an electromagnetic valve 35 is mounted in. Said valve 35 is fitted with a flow regulator which regulates the flow rate independently from the pressure.

Said water supply line opens above the uppermost end of said plate 13. The water being supplied flows from said plate 13 and through opening 17, into the water circuit.

When the ice around said rods 15 is thick enough, the ice forming is stopped and the resulting ice is removed.

To release the ice from plate 13 and rods 15, said ice should be somewhat thawed, which occurs by raising the temperature of plate 13 and rods 15.

Such thawing may occur in various ways, for example by means of electric resistors, by means of hot water, or by feeding hot fluid through line portions 9 and 10 of evaporator 1, which is for example left to operate as condenser.

Due to the structure of cooling element 12, it is also possible to cause the required thawing by feeding cold tap water, which is not only advantageous energywise, but mostly makes the structure simpler.

Even better, use may be made for thawing, of that water which has to be added after forming the ice, to bring the water level inside water tank 25 back to the initial level. This lowers the water consumption, the water being fed is already partly cooled before reaching water tank 25, and mostly the device structure is also very simple.

Due to the partitions 16, the water being fed flows zig-zag like over plate 13, whereby a good contact is obtained between said water and plate 13. Due to the water being fed not only contacting rods 15, but also line portions 9 and 10, the rods 15 are quite rapidly somewhat warmed by the water, so that the ice falls from said plate 13 and rods 15. The resulting ice cubes are collected by a grate 56 which lies inside collecting tray 20, from which they are removed to a reserve tank not shown in the figures for clearness' sake.

When in the above-described way, there is added through the water supply line 34, but as much water to the water circuit, as water was consumed during the previous cycle for forming ice, the concentration in dirt and salts would increase at each cycle in said water tank.

To avoid this, after each ice forming, more water is added to the water circuit than water is consumed during a previous cycle for forming ice, which thus also means that as the total water mass in the water circuit has to remain the same, at each cycle somewhat more water has to be removed from the water circuit than what is consumed for forming the ice.

This is obtained by removing a part of the water which flows through the water circuit during ice formation, and actually by means of a trough 36 which is hingedly fastened above water tank 25 about a horizontal axis 37, directed cross-wise to the lengthwise direction of the trough, to said underframe 26.

Due to the tilting, an uppermost end of trough 36 may be brought into the water circuit and actually opposite said outlet which comprises opening 23, pipe 24 and small trough 38. In this position, the lowermost end of trough 36 opens through a small tube 39 connected thereto and directed downwards, on the uppermost end of discharge pipe 29.

That water which flows through opening 23 and pipe 24 from tray 20, flows downwards over the lowermost end of said small trough 38, either in tank 25, or in trough 36, or still partly in trough 36 and partly in water tank 25, depending on the position of said trough 36.

Said position is determined by a float 40 which is part of the control device of the device for making ice cubes.

The float 40 floating on the water inside water tank 25 bears a substantially L-shaped lever 41. The vertical leg thereof stands on float 40. The end of the other leg is fast to a hinge axis 42 which is supported in underframe 26.

To hinge axis 42 is fastened a cam 43 which cooperates with a microswitch 44.

As it appears from FIG. 6, said microswitch 44 is mounted in an electric line 45, in series with a switch 46 and a voltage source 47, and in the one position thereof, also in series with the coil of electro-magnetic valve 35, and in the other position thereof, in series with the compressor 2, motor of fan 5 and motor 32 of pump 31, connected in parallel with each other.

Said switch 46 may be the starting button or a microswitch which, when enough ice cubes have fallen in the reserve tank which is not shown in the figures, is displaced by means of a lever and cuts off line 45.

A small arm 48 is secured to L-shaped lever 41. On said small arm, one end of an arm 49 bears, which is connected to the uppermost end of trough 36. When float 40 rises or falls, the trough 36 is swung with the uppermost end thereof upwards, respectively downwards until the uppermost end of trough 36 bears on the fixed small trough 38.

The amount water which is discharged through trough 36 to discharge pipe 29 and thus the additional water amount which is removed from the water circuit, is adjusted by means of the non-pivotable through 38. The higher said non-pivotable trough 38 is mounted, and the faster with a falling level inside water tank 25 and thus with a falling float 40, the uppermost end of trough 36 will catch the water which flows from small trough 38.

As due to the flowing away of part of the water over trough 36 directly to water discharge pipe 29, the water level inside water tank 25 falls even faster than due to ice forming alone, the water level reaches very rapidly that position whereby the cooling cycle is stopped.

The position of small trough 38 thus determines the duration of the cooling cycle and consequently the thickness of the ice around said rods 15.

The duration of the thawing cycle may also be adjusted by directing part of that water fed for thawing through water supply line 34, which water flows from plate 13, not directly to tank 25 but rather to discharge pipe 29.

For this purpose, below opening 17 in plate 13, a trough 50 slanting in the opposite direction to plate 13 is mounted. Said trough 50 is however closed by a vertical partition 51 which is provided with a vertical slot 52. The water flowing from plate 13 thus flows over trough 50 through said slot 52.

Above said collecting tray 20, a trough 53 is arranged. Said trough 53 is swingably fastened near to its lowermost end and above opening 23 in collecting tray 20, to said tray 20 about a horizontal axis 54 lying crosswise to the lengthwise direction of the trough.

Adjacent to its uppermost end, the trough 53 bears on one leg of an L-shaped lever 55 the other leg of which extends through wall 14.

By swinging said lever 55, it is possible to move upwards the uppermost end of trough 53, until the uppermost end lies above the water stream which flows through slot 52, or downwards until the uppermost end of through 53 lies in said water stream and depending on the position thereof, catches a larger or smaller portion of said stream and directs same to discharge pipe 29 through opening 23, small pipe 24, height-adjustable trough 38 and swingable trough 36, the uppermost end of which has to lie in the lowermost position thereof, on the small through 38.

When a new device is started, there is not water yet in water tank 25. The float 40 lies in the lowest position thereof and the microswitch 44 lies in that position whereby the coil of electro-magnetic valve 35 is connected in electric line 45.

As soon as the device is started, this coil is thus energized and the electro-magnetic valve 35 lets water through water supply line 34. Said water flows over plate 13 and through opening 17, over trough 50, through slot 52, through opening 21 and discharge part 22, in the water tank 25.

The trough 53 lies in the highest position thereof.

As the water tank 25 is being filled, the float 40 rises.

By means of float 40, through lever 41, trough 36 which lies with the uppermost end thereof on the small trough 38, is first swung upwards.

As soon as float 40 has reached the highest position thereof, it switches microswitch 44 through lever 41 and cam 42, over to the position shown in FIG. 6. The coil of electro-magnetic valve 35 is cut-off, whereby the water supply is stopped. The compressor 2, motor of fan 5 and motor 32 are connected in circuit 45, in such a way that said compressor 2, fan 5 and pump 31 start working.

On that moment where the microswitch 44 switches over, the water level inside water tank 25 lies above overflow opening 27,28 because more water was fed than there may flow away through said opening.

As soon as pump 31 starts working, said water level falls suddenly because said pump pumps water to the spray lines 19. Said sudden fall is partly balanced as during a short time, water still flows from cooling element 1.

The highest water level is so selected that after all the water has flowed from plate 13 into water tank 25, the water level lies somewhat above opening 27.

Due to the water supply being stopped, the water will flow away through opening 27 until the water level reaches the lower edge of said opening.

In this way, the water level may be defined accurately immediately before the ice forming proper occurs, independently of the right adjustment of microswitch 44, of the amount of water in the water circuit, and of the amount of water which still is on plate 13.

As the cooling device is working, the cooling element 12 is cooled. Simultaneously, with the pump 31, water is sprayed through the spraying openings 18 on the lower side of plate 13 and on said rods 15.

During a first stage, said water is cooled by the rods 15 and in a following stage, part of this water is converted into ice on said rods 15.

In proportion to the forming of ice, the water level inside water tank 25 falls. The float 40 falls and thereby also the trough 36 is swung downwards.

When the ice cubes around rods 15 are nearly thick enough, the water level has so fallen that trough 36 has also swung downwards in such a way that the uppermost end thereof remains hanging on small trough 38.

Part of the sprayed water now still flows through opening 21 to water tank 25, but that portion of said water which flows back through opening 23 to the water tank 25, is now catched by said trough 36 and lead directly to water discharge pipe 29.

As now more water escapes from the water circuit than what is required to form the ice, the water level inside water tank 25 falls very rapidly, so that float 40 reaches very rapidly its lowest position.

When float 40 has reached its lowest position, it switches through lever 41 and cam 43 said microswitch 44 back to the first-mentioned position for starting.

Thereby compressor 2, fan 5 and pump 31 are stopped, while valve 35 is opened.

The ice forming is now ended, and the thawing cycle begins.

Due to the water being fed, the ice cubes around rods 15 are sligthly thawed, so that they are released and collected on grate 56 lying on collecting tray 20 wherefrom said cubes slide to the collecting tank.

As a function of the temperature of the water being fed, the duration of the thawing cycle is regulated in the above-described way by adjusting trough 53. The water fed by trough 53 is lead to discharge pipe 59 because during the thawing cycle, trough 36 still lies in the lowest position thereof, bearing on small trough 38.

That water which is fed for thawing, flows completely or partly to water tank 25 which is filled again in this way, as described above for starting the device.

The water level will raise again to the maximum, and the above-described cycle will be further repeated.

As at each freezing and thawing cycle, more water is withdrawn from the water circuit than for the ice forming proper, part of the water is refreshed, so that the salt and dirt concentration in the water remains low.

The total amount of water which is withdrawn from the circuit as well for forming ice as for discharge through trough 36, is defined by the float positions, and also the amount of fresh water which is fed after a cycle to refill with water, is determined by the outermost positions of float 40. Said amounts and for a determined thickness of the ice cubes, the amount of water which is refreshed at each cycle, may be adjusted by adjusting with the immersion elements 30 the maximum amount of water which may be supplied to water tank 25.

Figure 8:
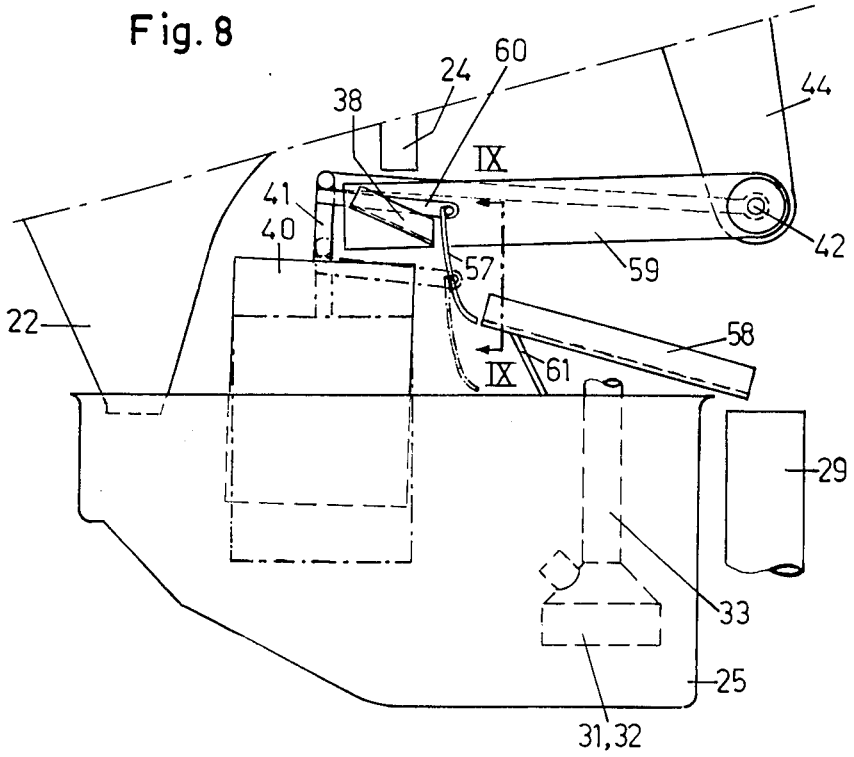
FIG. 8 is a side view of the lowermost portion of the device but with respect to another form of embodiment of the device according to the invention.
Figure 9:
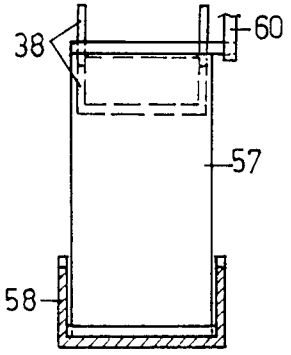
FIG. 9 shows a cross-section along line IX—IX in FIG. 8 but drawn on a greater scale.

The form of embodiment of the device according to FIGS. 8 and 9 differs essentially from the above described form of embodiment in that the means for removing a part of the water which flows through the water circuit during ice forming comprise as movable member instead of a tiltable through 36, an up-and-down movable deflector 57, in that consequently the overflow opening 26 in tank 25 is no longer present, in that the means for removing part of the water further comprise a slanting trough 58 cooperating with the deflector 57, and in that some elements like the discharge pipe 29 and the pump with motor 31,32 are different in location and/or construction. For practical reasons the small trough 38 of the tray outlet 23,24,38 extends in another direction as in the device according to FIGS. 1 to 7, and it is not adjustably mounted on the wall 14 but on an support arm 59 which is adjustably in direction mounted on the shaft 42. Said shaft is fixed to the wall 14 and as well the L-shaped lever 41 as the cam 43 connected thereto are rotatable around this fixed shaft 42.

The slanting trough 58 is fastened above water tank 25, opens with its lower end on the discharge pipe 29, and is situated with its upper end opposite but at a small distance from and a little lower than the lowermost end of small trough 38 of the tray outlet. The trough is so directed that water which flows from the small trough 38 and which is not deflected by deflector 57, falls on the trough 58.

The deflector 57 is a downwards extending slightly bent plate, the upper end of which is carried by an arm 60 fastened to the upstanding leg of L-shaped lever 41 mounted on the float 40.

During ice-forming, the deflector 57 is lying between the troughs 38 and 58. Its upper part lies in front of the lowermost end of trough 38 so that the excess water returning from the cooling element 12 bumps against the deflector 57 and flows downwards along said deflector 57. As the lower edge of said deflector 57 lies underneath the upper end of the trough 58, all said water is deflected to the water tank 25. Underneath the trough 58, the water is guided by means of a guide plate 61 by means of which trough 58 bears on tank 25.

In FIGS. 8 and 9 the deflector 57 is shown in full line in the position corresponding to the level at the beginning of the ice-forming.

Due to the ice forming, the water level in water tank 25 falls. When nearly enough ice has been formed the level has fallen so deeply that the deflector 57 carried by the float 40 lies with its uppermost part so low that it does not prevent water flowing from trough 38 to trough 58, and so to the water discharge pipe 29. As not only water is used for making ice but part is also discharged, the level will fall faster and when the uppermost part of deflector 57 lies completely underneath trough 38, all water flowing through water tray outlet 23,24,38 flows through trough 58 to the discharge pipe 29, and so the lowest level with which the float 40 switches through lever 41 and cam 43 the microswitch 44 in the position whereby the pump 31 is stopped and the thawing cycle begins as in the form of embodiment according to FIGS. 1 to 7, is reached quickly. The deflector 57 and the float 40 are shown in FIG. 8 in mixed lines in the position corresponding to this lowest level in tank 25.

The water fed for thawing flows partly through outlet 21,22 to water tank 25 and the level in tank raises.

Said raising of the level will be faster as soon as the deflector 57 lies in front of the end of trough 38 and deflects again part or all water flowing from tray outlet 23,24,38.

The float 40 will raise further and so high that the lowermost edge of deflector 57 lies above the uppermost end of the bottom of trough 58. The deflector 57 then deflects the water no longer to the water tank 25 but to said trough 58.

The raising of the level is now slower.

The float 40 reaches the point whereby it switches microswitch 44 through lever 41 and cam 43, over to the position shown in FIG. 6. As already explained with respect to the form of embodiment according to FIGS. 1 to 7, the water supply is stopped, the pump 31 starts working and the cooling cycle starts.

On the one hand some of the supplied water stills flows from the cooling element to the water tank but on the other hand, as soon as pump 31 starts, water is sucked away from water tank 25, and part of water flowing from the cooling element 15 through tray outlet 23,24,38, either from the water supply or pumped by pump 31, will be evacuated as long as the deflector 57 lies with its lowermost end above the uppermost end of trough 58.

After a short time and before the first ice has been formed, the water level in tank 25 will reach an equilibrium position.

Said equilibrium position which corresponds to the float 40 position whereby the lowermost end of deflector 57 lies just below the uppermost end of trough 58 is always the same. As the level at the starting of the ice-forming is accurately the same, the thickness of the ice-cubes can be accurately determined.

The invention is in no way limited to the above-described embodiments and within the scope of the patent application, many changes may be brought to the described embodiments notably regarding the shape, the composition, the arrangement and the number of the components which are being used to embody the invention.

For instance, the device does not necessarily have to comprise a swingable trough to adjust the thawing time.

As far as the device actually has such a swingable trough, said trough does not necessarily have to be swingable with a hand-adjusted lever. The lever swinging may for example be controlled by an electrostatic valve in the water supply line according to the water temperature.

In the form of embodiment according to FIGS. 8 and 9, the trough mounted above the water tank can, like the trough of the tray outlet, be adjustable in height. By adjusting the height of the trough above the water tank the moment that the lowermost end of the deflector lowers underneath the uppermost end of the trough and hence the equilibrium level in the water tank can be adjusted.

I claim:

1. A device for making ice cubes, which device comprises:

a cooling device with at least one cooling element, a water circuit which comprises:

a water tank, means for feeding water from the water tank to the cooling element, and means for returning the excess water, which has not been converted to ice, to the water tank, means for supplying before the ice formation water to said water tank, water discharge means, means for thawing somewhat after the ice formation, that ice formed on the cooling element, so that said ice is released from said cooling element, a control device which so controls the means for supplying water to the water tank, the means for feeding water to the cooling element and the means for thawing somewhat the ice after its formation, that, before forming the ice, some water is added to the water tank, after adding said water, the supply is stopped, and as soon as enough ice has been formed on the cooling element, the means for feeding water from the water tank to the cooling element, stop the water feed, and the means for thawing somewhat the ice are started, and means for diverting during ice formation, a portion of that water circulating in the water circuit and leading same to the water discharge means, said means for diverting a portion of the water comprising a movable water-guiding member which is mounted in or on the water circuit, which member is movable between a position wherein at least a portion of the water flowing in said circuit is diverted to the water discharge means and a position wherein diverting does not occur, and which member is controlled by the control device so as to move from one position to the other in function of the water level in the water tank.

2. A device as defined in claim 1, in which the means for returning the excess water comprise a collecting tray which is arranged underneath the cooling element and collects that water which has not been used for forming ice, said tray being provided with an outlet to discharge part at least of the collected water, which outlet opens on the water tank, while the means for diverting at least a portion of the water are mounted underneath said outlet so that in one position at least of the movable member a portion of the water returning from the cooling element is diverted.

3. A device as defined in claim 2, in which the control device comprises a float which is mounted inside said water tank, said float so controlling the means for feeding water to the cooling element, that when the water in the water tank falls below some determined level, said means are cut-off and the water feed to the cooling element stops, and in that the movable member is connected to said float and is brought by said float from one position to the other.

4. A device as defined in claim 3, in which the movable member is a trough which is swingably mounted about a substantially horizontal axis directed cross-wise to the trough, above said water tank, and in one position lies on the one hand with its uppermost end opposite said tray outlet to collect part at least of the water flowing out of said outlet and on the other hand opens with its lowermost end on said water discharge means, which trough is so connected to the control device float that when said float falls below some determined limit, the trough is brought to the last-mentioned position.

5. A device as defined in claim 3, in which the movable member is a deflector fixed on the float, and in that the means for diverting at least a portion of the water comprise also a slanting trough mounted with its lowermost end opening on the water discharge means and with its uppermost end lying opposite the tray outlet so that the tray outlet opens on it, the deflector lying in one position between the tray outlet and the uppermost end of the trough so as to deflect water from the tray outlet to the water tank, and lying in another lower position sufficiently away from the tray outlet to permit water streaming from the tray outlet in the trough and over the trough to the discharge means.

6. A device as defined in claim 2, in which the collecting tray outlet underneath which the means for diverting at least a portion of the water are mounted comprises a small trough slantingly mounted adjustably in the height underneath said tray, the movable member of said means for diverting being mounted near the lowermost end of said small trough.

7. A device as defined in claim 3, in which the means for feeding water to the cooling element, comprise a line and an electric pump mounted therein, while the control device comprises a microswitch which controls the pump, which microswitch is in turn controlled by the float in such a way that the pump is cut-off as soon as the float falls below some determined limit.

8. A device as defined in claim 1, which further comprises at least one immersion element which is so mounted in the water tank as to be adjustable in the height, and determines the amount of water for the highest level inside the water tank.

9. A device as defined in claim 1, in which said cooling element comprises a plate which is arranged at an angle to the vertical direction, a number of downward-directed fingers which extend through the plate, and a cooling liquid line which engages the fingers on the plate upper side, while the means for feeding water to the cooling element, comprise means for moistening the plate bottom side and the ends projecting thereunder of the fingers, and the means for returning the excess water to the water tank comprise a collecting tray which is arranged underneath said plate.

10. A device as defined in claim 9, in which said cooling liquid line comprises at least one pair of line portions extending in parallel relationship to one another, and those ends, lying above the plate, of said fingers lie between the line portions from a pair, in engagement with said line portions, the cooling device comprising means for feeding cooling liquid in opposite flow directions through both line portions from a pair.

11. A device as defined in claim 9, in which the fingers are solid metal rods.

12. A device as defined in claim 9, in which the means for thawing somewhat after ice forming, the formed ice to release same from said fingers comprise means for feeding water above the plate.

13. A device as defined in claim 12, in which the means for thawing somewhat after ice forming, the formed ice, comprise means for directing the water from the cooling element plate partly at least to the water tank, and the means for feeding water for thawing are also the means for feeding water to the water tank.

14. A device as defined in claim 13, in which the means for thawing somewhat after ice forming, the formed ice also comprise means to be switched in and out for collecting part of the thawing water flowing from the cooling element plate and direct same to the water discharge means instead of to the water tank.

15. A device as defined in claim 14, in which the means for collecting part or the thawing water flowing from the cooling element plate and direct same to the water discharge means, comprise a trough which is swingably mounted about a substantialiy horizontal axis directed cross-wise to the lengthwise direction of the trough, below the cooling element plate, and in at least one position on the one hand lies with the uppermost end thereof in the water stream which flow from the plate to the water tank to divert part at least of said stream, and on the other hand opens with the lowermost end thereof on the water discharge means.

16. A device as defined in claim 15, in which the cooling element plate is slanting and is provided on the lowermost end thereof with a discharge opening and in that, underneath said opening a collecting trough is mounted which is closed by a partition wherein a vertical slot is provided, and the swingable trough from the means for directing a part of the thawing water to the water discharge means, lies in one position with the uppermost end thereof facing the slot, in the water stream which flows through said slot.

* * * * *